United States Patent [19]

DuBois et al.

[11] 4,241,687

[45] Dec. 30, 1980

[54] THROTTLE CONTROL FOR A MARINE PROPULSION DEVICE

[75] Inventors: Edmund H. DuBois, Zion, Ill.; Robert K. Erlandson, Kenosha, Wis.; Allan F. Miller, Lindenhurst, Ill.

[73] Assignee: Outboard Marine Corporation, Waukegan, Ill.

[21] Appl. No.: 959,890

[22] Filed: Nov. 13, 1978

[51] Int. Cl.[3] ..... B63H 21/26

[52] U.S. Cl. ..... 440/63; 74/107; 74/488; 440/87

[58] Field of Search ..... 115/17, 18 R; 123/98; 74/480 B, 488, 107

[56] References Cited

U.S. PATENT DOCUMENTS

| | | | |
|---|---|---|---|
| 1,804,442 | 5/1931 | Smith | 74/480 B X |
| 1,932,521 | 10/1933 | Irgens | 115/17 |
| 2,615,418 | 10/1952 | Aspenleiter | 74/480 B X |
| 2,624,212 | 1/1953 | Urquhart | 74/480 B X |
| 2,644,419 | 7/1953 | Heidner et al. | 123/98 X |
| 2,651,278 | 9/1953 | Davison et al. | 74/480 B X |
| 2,751,799 | 6/1956 | Long | 115/17 X |
| 2,826,931 | 3/1958 | Michler | 74/480 B X |
| 2,906,251 | 9/1959 | Soder, Jr. | 123/98 X |
| 3,386,308 | 6/1968 | Butler | 74/480 B |
| 3,922,996 | 12/1975 | Meyer | 74/480 B X |

*Primary Examiner*—George E. A. Halvosa
*Attorney, Agent, or Firm*—Michael, Best & Friedrich

[57] ABSTRACT

A marine propulsion device comprises a marine propulsion unit including an engine mounted on the marine propulsion unit and a propeller rotatably mounted on the marine propulsion unit and operatively connected with the engine. The engine has a throttle movable between an idle position for operating the engine at an idle speed and an advanced position for operating the engine at a speed above the idle speed. A steering handle is attached to the marine propulsion unit and a throttle grip is attached to the steering handle for rotation relative thereto. A throttle linkage assembly operatively connects the throttle grip with the throttle and is movable axially of the axis of rotation of the throttle grip for moving the throttle between the idle position and the advanced position in response to rotation of the throttle grip.

16 Claims, 3 Drawing Figures

THROTTLE CONTROL FOR A MARINE PROPULSION DEVICE

BACKGROUND OF THE INVENTION

I. Field of the Invention

The invention relates generally to marine propulsion devices, and more particularly, to throttle controls for marine propulsion devices. Still more particularly, the invention relates to throttle controls for outboard motors.

II. Description of the Prior Art

Attention is directed to marine propulsion devices which are disclosed in the following U.S. Patents:

| | | |
|---|---|---|
| Smith | 1,804,442 | May 12, 1931 |
| Davison et al | 2,651,278 | September 8, 1953 |
| Michler | 2,826,931 | March 18, 1958 |
| Soder | 2,906,251 | September 29, 1959 |
| Bergstedt | 3,171,382 | March 2, 1965 |
| Morse | 3,403,578 | October 1, 1968 |
| Ranft | 3,482,562 | December 9, 1969 |
| Albertson | 3,742,928 | July 3, 1973 |
| Lariviere | 3,726,264 | April 10, 1973 |
| Meyer | 3,922,996 | December 2, 1975 |
| Zakrzewski | 3,955,438 | May 11, 1976 |

Throttle control mechanisms which are carried by the steering handle of a marine outboard motor and which translate the rotational movement of a throttle control "twist" grip into movement of the throttle itself are known and disclosed by Smith, Davison, Michler, Soder, and Meyer. In Smith, the "twist" grip rotates the entire steering handle which is operatively connected to the throttle by means of an integral crank arm assembly. In Michler and Soder, the "twist" grip rotates a shaft enclosed within the steering handle, which shaft is operatively connected by means of gears to the throttle. In Davison and Meyer, a pair of push-pull cables are wrapped around a drum mechanism which is rotated in response to the "twist" grip.

None of the above cited prior art discloses a throttle control mechanism which is carried by the steering handle of a marine outboard motor and which translates the rotational movement of a throttle control "twist" grip into linear movement of a single push-pull throttle cable axially of the axis of rotation of the "twist" grip to thereby operate the throttle. In addition, none of the above cited prior art discloses a throttle control mechanism which includes a throttle adjusting screw carried by the steering handle for adjusting the operational idle speed of the engine.

SUMMARY OF THE INVENTION

The invention provides a marine propulsion device comprising a marine propulsion unit including an engine mounted on the marine propulsion unit and having a throttle movable between an idle position for operating the engine at an idle speed and an advanced position for operating the engine at a speed above the idle speed, a propeller rotatably mounted on the marine propulsion unit and operatively connected with the engine, a steering handle attached to the marine propulsion unit, throttle grip means attached to the steering handle for rotation relative thereto in first and second opposite rotational directions, and throttle linkage means operatively connected with the throttle grip means and the throttle and movably axially of the axis of rotation of the throttle grip means for moving the throttle between the idle position and the advanced position in response to rotation of the throttle grip means, which throttle linkage means includes first stop means for preventing rotation of the throttle grip means in the first rotational direction when the throttle is located in the idle position, second stop means for preventing rotation of the throttle grip means in the second rotational direction when the throttle is located in the advanced position, and third stop means for selectively preventing rotation of the throttle grip means in the first rotational direction before the throttle reaches the idle position, notwithstanding the first stop means.

The invention also provides a marine propulsion device comprising a marine propulsion unit including an engine having a throttle movable between an idle position for operating the engine at an idle speed and an advanced position for operating the engine at a speed above the idle speed, a propeller rotatably mounted on the marine propulsion unit and operatively connected with the engine, a tubular steering handle having an inner end attached to the marine propulsion unit, and an oppositely spaced outer end having a slot formed thereon axially of the longitudinal axis of the steering handle and including axially spaced first and second ends, throttle grip means attached to the outer end for rotation relative thereto, a helical groove formed on the interior portion of the throttle grip means axially of the rotational axis of the throttle grip means, a throttle cable carried within the tubular steering handle and having opposite end portions, one of the end portions being operatively connected with the throttle, a pin attached to the end of the throttle cable opposite from the throttle, which pin is movably engaged in the axial slot and engaging the helical groove for displacing the pin in the axial slot and thus displacing the throttle cable axially of the rotational axis of the throttle grip means between an idle position and an advanced position in response to rotation of the throttle grip means, thereby moving the throttle between the idle position and the advanced position, and adjustable stop means for selectively making abutting contact with the pin in response to movement thereof toward the idle position prior to location of the pin in the idle position.

One of the principal features of the invention is the provision of a throttle control mechanism carried by the steering handle of a marine outboard motor, which throttle control mechanism translates the rotational movement of a throttle control "twist" grip into linear movement of a single push-pull throttle cable axially of the axis of rotation of the "twist" grip to thereby operate the throttle.

Another of the principal features of the invention is the provision of a throttle control mechanism carried by the steering handle of a marine outboard motor, which throttle control mechanism includes an adjustable throttle stop member so that a low operational speed which is above the idle speed of the engine may be selected.

Other features and advantages of the embodiments of the invention will become known by references to the following general description, claims, and drawings.

Figure 1:
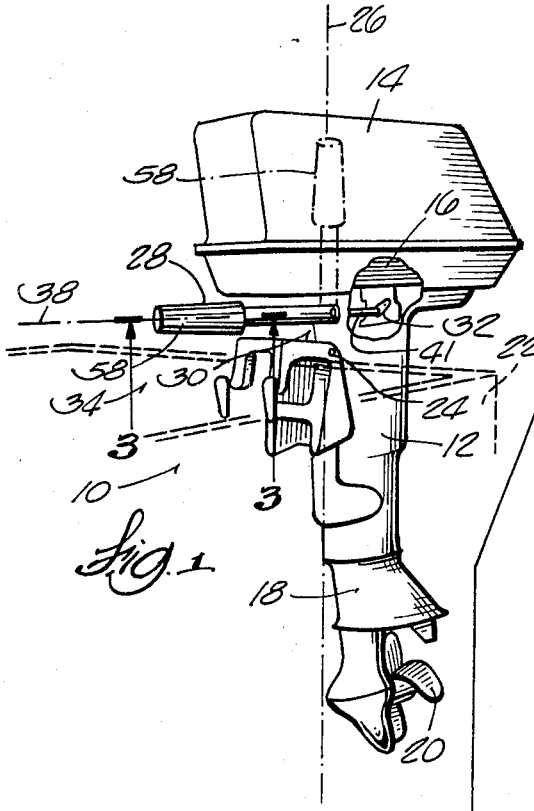
FIG. 1 is a marine propulsion device including a throttle control mechanism which embodies various of the features of the invention.

Before explaining the one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology used herein for the purpose of description should not be regarded as limiting.

GENERAL DESCRIPTION

Shown in FIG. 1 is a marine propulsion device 10 which embodies various of the features of the invention, which, in the illustrated embodiment, is in the form of an outboard motor, and which includes a propulsion unit 12 having a powerhead section 14 including an engine, typically an internal combustion engine 16, and a lower drive section 18 upon which a propeller 20 is rotatably mounted. The propeller 20 is operatively connected by a drive train mechanism (not shown) with the engine 16.

The propulsion unit 12 is attached to the transom 22 of a boat by a suitable swivel bracket assembly 24 so that the entire propulsion unit 12 is supported for pivotal movement about a vertical axis 26. The boat is steered through the water by pivoting the propulsion unit 12 upon the swivel bracket assembly 24, and the device 10 includes a steering handle 28, or tiller, attached to the propulsion unit 12 so that the operator may steer while being seated within the boat.

Figure 2:
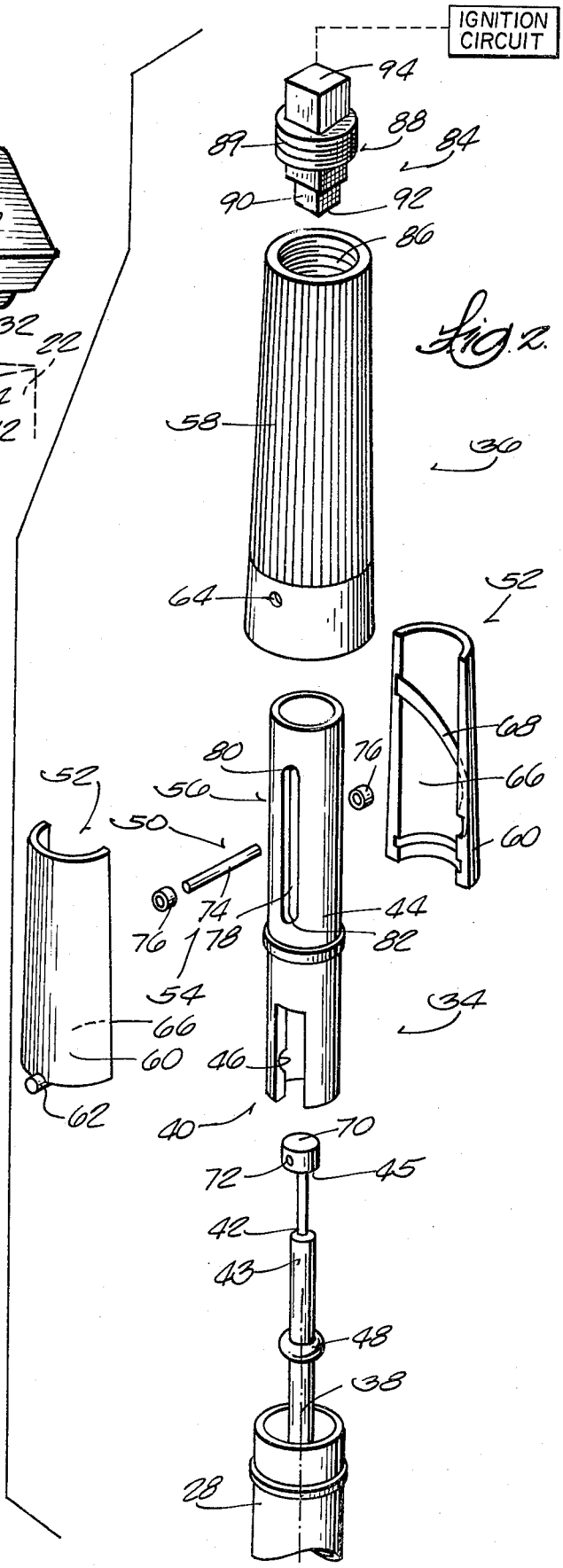
FIG. 2 is an exploded view of part of the throttle control mechanism incorporated in the device shown in FIG. 1.

While the steering handle 28 may be variously constructed, in the illustrated embodiment, and as is best shown in FIG. 2, the steering handle 28 is of tubular construction and has an inner end 30 (see FIG. 1) which is pivotally connected to the powerhead section 14 by suitable means. By virtue of this construction, the steering handle 28 is movable between an upstanding position (shown in phantom lines in FIG. 1) in which the steering handle 28 is located in an out-of-the-way or inoperative position and an outwardly extending position (shown in solid lines in FIG. 1) in which the longitudinal axis 38 of the steering handle 28 extends generally perpendicularly outwardly of the vertical pivot axis 26 and is thus in an operative position for steering the boat.

The engine 16 includes a throttle 32 (see FIG. 1) for controlling the speed of the engine 16 and thereby determining the speed of the boat through the water. The throttle 32 is movable between an idle position for operating the engine 16 at an idle speed and an advanced position for operating the engine 16 at a speed above the idle speed. In order that the operator may control the speed of the boat simultaneously with steering the boat, a throttle control mechanism 34 is carried by the steering handle.

In general, and referring now to FIG. 2, the throttle control mechanism 34 includes throttle grip means 36 attached to the steering handle 28 and rotatable by the operator relative to the longitudinal axis 38 of the steering handle 28 in both a clockwise and counterclockwise direction. Throttle linkage means 40 operatively interconnects the throttle grip means 36 with the throttle 32 and is movable axially of the longitudinal axis 38 of the steering handle 28 such that rotation of the throttle grip means 36 displaces the throttle 32 between its idle position and its advanced position.

More particularly, and still referring to FIG. 2, the throttle linkage means 40 includes a throttle cable 42 which is movably enclosed within a protective sleeve 43 typically made of rubber or plastic. The throttle cable 42 and sleeve 43 pass through the tubular steering handle 28. One end 41 of the throttle cable 42 is operatively coupled with the throttle 32 (see FIG. 1), and the other end 45 is operatively coupled with the throttle grip means 36.

The steering handle 28 includes an outer handle member 44 fastened upon the outermost end of the steering handle 28. The outer handle or extension member 44 includes an interior groove 46 which mates with a shoulder 48 formed on the protective sleeve 43 (see also FIG. 3), thus preventing movement of the protective sleeve 43 within the steering handle 28, while permitting the throttle cable 42 to be moved within the sleeve 43 to thereby displace the throttle 32 between its idle position and its advanced position.

The throttle linkage means 40 further includes first means 50 for translating the rotational movement of the throttle grip means 36, which rotational movement is relative to the longitudinal axis 38 of the steering handle 28, to the linear movement of the throttle cable 42, which linear movement is axially of the longitudinal axis 38. While the first means 50 may be variously constructed, in the illustrated embodiment, a helical cam means 52 is located on the throttle grip means 36 for common rotation therewith and associated pin follower means 54 is located on the end 45 of the throttle cable 42 opposite to the throttle 32. In addition, second means 56 is located on the steering handle 28 and the throttle cable 42 for preventing rotation of the throttle cable 42 relative to the steering handle 28 in response to the interaction between the cam means 52 and the pin follower means 54, thereby translating the interaction between the cam means 52 and the pin follower means 54 into the desired movement of the throttle cable 42 axially of the longitudinal axis 38 of the steering handle 28.

More particularly, the throttle grip means 36 includes an outer grip member 58 which is mounted on the outer handle member 44 for rotation relative to the longitudinal axis 38. The outer grip member 58 preferably includes a rough exterior portion to enhance the operator's grip on and thus rotation of the member 56. An inner sleeve member 60 snugly fits within the outer grip member 58, and a pair of tabs 62 which protrude outwardly of the inner sleeve member 60 mate with a pair of holes 64 located on the outer grip member 58 (see also FIG. 3) so that the outer grip member 58 and the inner sleeve member 60 are coupled for common rotation about the longitudinal axis 38 of the steering handle 28.

The inner sleeve member 60 includes an interior surface portion 66 which encircles the outer handle member 44, and the cam means 52 includes a helical groove 68 which is formed in the interior surface portion 66 axially of the longitudinal axis 38.

As is best seen in FIG. 2, the pin follower means 54 includes a shoulder 70 formed on the end 45 of the throttle cable 42. A hole 72 passes through the shoulder 70, through which hole 72 a pin 74 is inserted (see FIG. 3). Roller bearings 76 or the like are rotatably fastened to the outer ends of the pin 74, such that the roller bearings 76 are in operative engagement in the helical groove 68.

Figure 3:
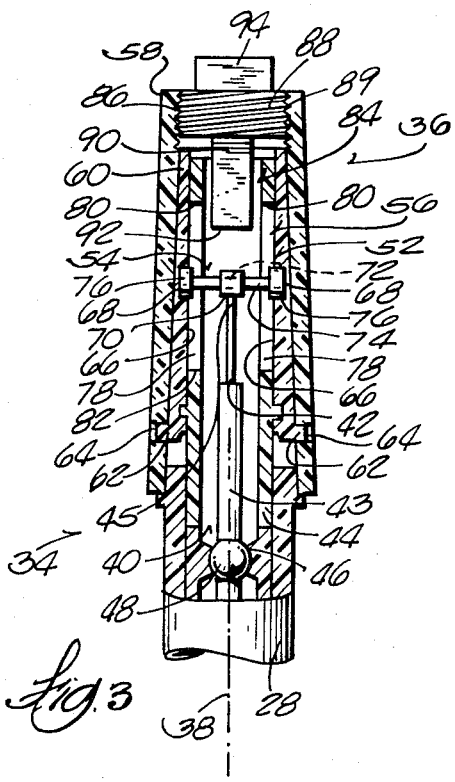
FIG. 3 is a sectional view taken generally along line 3—3 in FIG. 1.

The second means 56 includes a pair of oppositely spaced, elongated axial slots 78 formed on the outer handle member 44, which slots 78 include generally aligned uppermost ends 80 and lowermost ends 82. As can be seen in FIGS. 2 and 3, the pin 74 which passes through the hole 72 in the shoulder 70 is also engaged by the slots 78 (see FIG. 3). The entire end portion 45 of the throttle cable 42 is thereby restrained from rotating relative to the longitudinal axis 38 of the steering handle 28, while the pin 74 is permitted to move axially between the uppermost ends 80 and lowermost ends 82 of the slots 78, thereby moving the throttle cable 42 to operate the throttle 32.

More particularly, as the operator twists the outer grip member 58 relative to the longitudinal axis 38 of the steering handle 28, thereby rotating the inner sleeve member 60, the roller bearings 76 follow the progressively advancing helical groove 68. The pin 74, being rotatably restrained by the slots 78, slides axially along the slots 78 between the uppermost ends 80 and the lowermost ends 82. The throttle cable 42 is thereby displaced axially of the longitudinal axis 38 of the steering handle 28 to operate the throttle 32.

The uppermost ends 80 and the lowermost ends 82 of the slots 78 act as stops which define the limits of throttle cable movement. More particularly, rotation of the outer grip member 58 in one direction (which is a counterclockwise direction in FIG. 3) is permitted until the pin 74 abuts against the uppermost ends 80 of the slots 78, thereby defining a first rotational position. Likewise, rotation of the outer grip member 58 in the opposite direction (or clockwise in FIG. 3) is permitted until the pin 74 abuts against the lowermost ends 82 of the slots 78, thereby defining a second rotational position. Furthermore, the uppermost and lowermost ends 80 and 82 of the slots 78 are formed such that, when the pin 74 abuts against the uppermost ends 80, the throttle 32 is disposed in its idle position, and, when the pin 74 abuts against the lowermost ends 82, the throttle 32 is disposed in its advanced position.

As has been heretofore described, the low operational engine speed obtained when the outer grip member 58 is located in the first rotational position, thereby locating the pin 74 in abutting contact with the uppermost edges 80 of the slots 78, corresponds with the actual idle speed of the engine 16. In order that the operator may select a low operational engine speed which is above the actual idle speed of the engine 16, a low speed stop assembly 84 is operatively connected with the throttle control mechanism 34. In general, the low speed stop assembly 84 is adjustably located so as to make abutting contact with the shoulder 70 before the pin 74 reaches the uppermost edges 80 of the slots 78, thereby preventing the throttle cable 42 from returning the throttle 32 to the actual idle speed position and, in effect, defining a new and slightly advanced first rotational position at which a slightly advanced idle speed occurs.

While the low speed stop assembly 84 may be variously constructed, in the illustrated embodiment, the outer grip member 58 includes an internally threaded open end portion 86, and an idle adjusting screw member 88 having an externally threaded portion 89 is threaded upon the open end portion 86. A downwardly projecting stop tab member 90 is attached to the adjusting screw member 88 so that, as the screw member 88 is rotated relative to the outer grip member 58, the stop tab member 90 advances axially of the rotational axis of the outer grip member 58.

As can be seen in FIG. 3, rotation of the screw member 88 relative to the outer grip member 58 will adjust the distance which the terminal end 92 of the stop tab member 90 projects into the interior of the outer handle member 44 between the slots 78, and in particular, adjust the distance between the uppermost ends 80 of the slots 78 and the terminal end 92 of the stop tab member 90. When the terminal end 92 of the stop tab member 90 is located above the uppermost ends 80 of the slots 78, thereby defining a retracted position, the stop tab member 90 is inoperative for stopping throttle cable movement. However, when the terminal end 90 is located below the uppermost ends 80 (as is shown in FIG. 3), thereby defining a range of extended positions, as the outer grip member 58 is twisted from the second rotational position toward the first rotational position (or counterclockwise), the shoulder 70 will make abutting contact with the terminal end 92 before the pin 74 reaches the uppermost ends 80 of the slots 78. The axial displacement of the throttle cable 42 which moves the throttle 32 from the advanced position toward the actual idle position is thereby halted before the actual idle position is reached. As a result, when the outer grip member 58 reaches this slightly advanced first rotation position, a low operational engine speed which is above the actual idle speed occurs.

By rotating the screw member 88 relative to the outer grip member 58, the exact position of the terminal end 92 relative to the uppermost ends 80 of the slots 78 can be adjusted, and the operator is thus able to select the low operational speed desired within a predetermined range of engine speeds.

In the illustrated embodiment, a switch 94 is carried by the idle adjusting screw 88. The switch 94 can be electrically interconnected by suitable means (not shown) extending through the tubular steering handle 28 with the ignition circuit of the engine 16 (also not shown), such that operation of the switch 94 will electrically ground the ignition circuit and thus "kill" the engine 16.

As should now be apparent, the throttle control mechanism 34 as heretofore described permits the operator to control the speed of the boat through the water, to select the operational low speed desired, and to quickly terminate engine operation should it become necessary to do so. The location of the throttle control mechanism 34 in the steering handle 28 permits the operator to perform the above-mentioned functions simultaneously with steering the boat.

Various of the features of the invention are set forth in the following claims.

What is claimed is:

1. A marine propulsion device comprising a marine propulsion unit including an engine having a throttle movable between an idle position for operating said engine at an idle speed and an advanced position for operating said engine at a speed above the idle speed, said marine propulsion unit further including a propeller rotatably mounted on said marine propulsion unit and operatively connected with said engine, a steering handle attached to said marine propulsion unit, throttle grip means attached to said steering handle for rotation relative thereto in first and second opposite rotational directions, and throttle linkage means operatively connected with said throttle grip means and said throttle and movable axially of the axis of rotation of said throttle grip means for moving said throttle between said idle position and said advanced position in response to rotation of said throttle grip means, said throttle linkage means including first stop means for preventing rotation of said throttle grip means in the first rotational direction when said throttle is located in said idle position and second stop means for preventing rotation of said throttle grip means in the second rotational direction when said throttle is located in said advanced position, said throttle linkage means further including third stop means for selectively preventing rotation of said throttle grip means in the first rotational direction before said throttle reaches said idle position, notwithstanding said first stop means.

2. A marine propulsion device according to claim 1 wherein said throttle linkage means includes a throttle cable having opposite end portions, one of said end portions being operatively connected with said throttle, and first means connected to the other end of said throttle cable and to said steering handle and to said throttle grip means for displacing said throttle cable axially of the rotational axis of said throttle grip means in response to rotation of said throttle grip means.

3. A marine propulsion device according to claim 2 wherein said first means includes second means for preventing rotation of said throttle cable relative to said steering handle while permitting axial movement of said throttle cable along the rotational axis of said throttle grip means in response to said first means.

4. A marine propulsion device according to claim 3 wherein said second means includes a slot in said steering handle and extending axially of the rotational axis of said throttle grip means, and a member connected to the end of said throttle cable opposite from said throttle and being movable in said slot.

5. A marine propulsion device according to claim 3 wherein said first means includes helical cam means on said throttle grip means for common rotation with said throttle grip means, and pin follower means on the end of said throttle cable opposite from said throttle for engagement with said helical cam means.

6. A marine propulsion device according to claim 5 wherein said helical cam means includes an inner sleeve member operatively connected for common rotation with said throttle grip means and positioned intermediate said steering handle and said throttle grip means, said inner sleeve member including an interior portion facing said steering handle, a generally helical groove formed on said interior portion axially of the common rotational axis of said throttle grip means and said inner sleeve member, and wherein said pin follower includes a pin having an outer end portion, and bearing means attached to said outer end portion and engaging said helical groove.

7. A marine propulsion device according to claim 1 and further including mounting means for pivotally connecting said steering handle to said marine propulsion unit for movement between an inoperative position in which said steering handle is adjacently located along said marine propulsion unit and an operative position in which said steering handle extends generally perpendicularly outwardly of said marine propulsion unit.

8. A marine propulsion device according to claim 1 wherein said steering handle includes a tubular member having an inner end attached to said marine propulsion unit and an oppositely spaced outer end, wherein said throttle grip means is attached to said outer end, and wherein said throttle linkage means is carried within said tubular member.

9. A marine propulsion device according to claim 1 wherein said throttle includes an advanced idle position adjacent to said idle position and between said idle position a said advanced position, and a plurality of operative positions between said idle position and said advanced idle position, and wherein said third stop means includes adjusting means for positioning said third stop means between a retracted position in which rotation of said throttle grip means in the first rotational direction is prevented by said first stop means, a fully extended position in which rotation of said throttle grip means in the first rotational direction is prevented by said third stop means when said throttle is in said advanced idle position, and a plurality of partially extended positions between said retracted position and said fully extended position in which rotation of said throttle grip means in the first rotational direction is prevented by said third stop means when said throttle is in a selected one of said plurality of operative positions between said idle position and said advanced idle position.

10. A marine propulsion device according to claim 9 wherein said steering handle includes an outer end portion, an outer extension member fastened to said outer end portion, wherein said first stop means and said second stop means are carried by said outer extension member, wherein said throttle grip means includes an outer grip member attached to said outer extension member for rotation relative thereto, and wherein said third stop means and said adjusting means are carried by said outer grip member.

11. A marine propulsion device according to claim 10 wherein said outer grip member includes an internally threaded end portion, wherein said adjusting means includes an externally threaded screw member threadably engaging said internally threaded end portion for rotation with and relative to said outer grip member, wherein said third stop means includes a tab member attached to said screw member and movable axially of the rotational axis of said outer grip member between said retracted position and said fully extended position in response to rotation of said screw member relative to said outer grip member, and wherein said throttle linkage means makes abutting contact with said tab member during rotation of said outer grip member in the first rotational direction when said tab member is located between said retracted position and said fully extended position and with said first stop means when said tab member is located in said retracted position.

12. A marine propulsion device according to claim 1 wherein said engine includes an electrically actuated ignition circuit, and further including switch means carried by said third stop means and electrically connected with said ignition circuit for selectively grounding said ignition circuit.

13. A marine propulsion device comprising a marine propulsion unit including an engine having a throttle movable between an idle position for operating said engine at an idle speed and an advanced position for operating said engine at a speed above the idle speed, said marine propulsion unit further including a propeller rotatably mounted on said marine propulsion unit and operatively connected with said engine, a tubular steering handle having an inner end attached to said marine propulsion unit, and an oppositely spaced outer end having a slot formed thereon axially of the longitudinal axis of said steering handle and including axially spaced first and second ends, throttle grip means attached to said outer end for rotation relative thereto, a helical groove formed on the interior portion of said throttle grip means axially of the rotational axis of said throttle grip means, a throttle cable carried within said tubular steering handle, said throttle cable having opposite end portions, one of said end portions being operatively connected with said throttle, a pin attached to the end of said throttle cable opposite from said throttle, said pin being movably engaged in said axial slot and engaging said helical groove for displacing said pin in said axial slot and thus displacing said throttle cable axially of the rotational axis of said throttle grip means between an idle position and an advanced position in response to rotation of said throttle grip means, thereby moving said throttle between said idle position and said advanced position, and adjustable stop means for selectively making abutting contact with said pin in response to movement thereof toward said idle position prior to location of said pin in said idle position.

14. A marine propulsion device according to claim 13 wherein said slot includes a first end making abutting contact with said pin when said throttle is located in said idle position and a second end axially spaced from the first end and making abutting contact with said pin when said throttle is located in said advanced position, and wherein said adjustable stop means includes adjustable stop tab means for selectively making abutting contact with said pin prior to said pin making abutting contact with said first end.

15. A marine propulsion device according to claim 13 wherein said throttle grip means includes an internally threaded end portion, and wherein said adjustable stop means includes an externally threaded screw member threadably engaging said internally threaded end portion for rotation with and relative to said throttle grip means, a tab member attached to said screw member and having a terminal end portion movable axially of the rotational axis of said throttle grip means in response to rotation of said screw member relative to said throttle grip means between a retracted position in which said terminal end is spaced farther from said pin than said first end, and an extended position in which said terminal end is spaced closer to said pin than said first end.

16. A marine propulsion device according to claim 15 wherein said engine includes an electrically actuated ignition circuit, and wherein said device further includes switch means carried by said screw member and electrically connected with said ignition circuit for selectively grounding said ignition circuit.

* * * * *